United States Patent [19]

Bolza-Schunemann

[11] Patent Number: 4,488,485

[45] Date of Patent: Dec. 18, 1984

[54] SIMPLIFIED INKING UNIT

[75] Inventor: Hans-Bernhard Bolza-Schunemann, Wurzburg, Fed. Rep. of Germany

[73] Assignee: Koenig & Bauer Aktiengesellschaft, Wurzburg, Fed. Rep. of Germany

[21] Appl. No.: 497,539

[22] Filed: May 24, 1983

[30] Foreign Application Priority Data

Jun. 3, 1982 [DE] Fed. Rep. of Germany ..... 3220926

[51] Int. Cl.[3] ..... B41F 31/00

[52] U.S. Cl. ..... 101/350; 101/364

[58] Field of Search ..... 101/350, 351, 352, 349, 101/363, 364, 207–210

[56] References Cited

U.S. PATENT DOCUMENTS

| | | | |
|---|---|---|---|
| 2,595,070 | 4/1952 | Garrahan | 101/350 |
| 3,760,722 | 9/1973 | Thorson et al. | 101/350 |
| 3,785,285 | 1/1974 | Chambon | 101/350 X |
| 3,926,114 | 12/1975 | Matuschke | 101/350 X |
| 4,127,067 | 11/1978 | Dahlgren et al. | 101/350 X |
| 4,148,256 | 4/1979 | Fischer | 101/350 |
| 4,414,897 | 11/1983 | Sato et al. | 101/350 X |

OTHER PUBLICATIONS

Deutscher Drucker, pp. 8 & 10, Mar. 18, 1982, vol. 10.

*Primary Examiner*—William Pieprz
*Assistant Examiner*—Moshe I. Cohen
*Attorney, Agent, or Firm*—Jones, Tullar & Cooper

[57] ABSTRACT

A simplified inking unit for use with a web-fed rotary printing machine is disclosed. A plate cylinder and inking roller, which uses thinly liquid ink, rotate at the same peripheral speed and have the same diameters. A screened ink metering cylinder and cooperating ink fountain roller have diameters smaller than those of the plate cylinder and inking roller and rotate at lesser peripheral speeds than the inking roller. These two smaller rollers also rotate at different speeds with respect to each other with the ink fountain roller having the slowest rotational speed.

1 Claim, 1 Drawing Figure

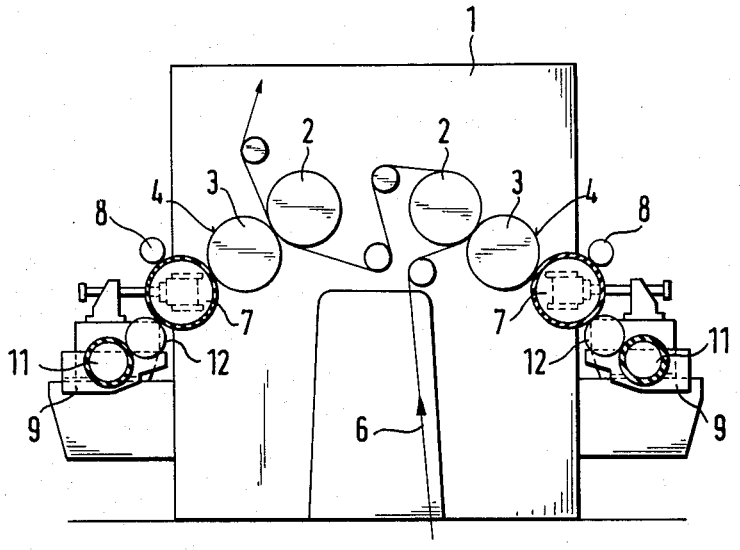
1
2
2
3
3
4
4
8
8
7
7
11
11
12
12
9
9
6

SIMPLIFIED INKING UNIT

FIELD OF THE INVENTION

The present invention is directed to an inking unit. More particularly, the present invention is directed to a simplified inking unit for use in a web-fed rotary printing machine. Most specifically, the present invention is directed to a simplified inking unit having an inking roller, an ink metering roller, and an ink fountain roller. The ink fountain roller and ink metering roller contact each other and the ink metering roller also is in contact with the inking roller. Both the ink fountain roller and ink metering roller have diameters smaller than that of the inking roller which is the same diameter as the plate cylinder. The inking roller and plate cylinder rotate at the same peripheral speed while the ink metering roller and ink fountain rollers rotate at lesser peripheral speeds which are not the same; the ink fountain roller having the slowest peripheral speed of rotation.

DESCRIPTION OF THE PRIOR ART

Inking units for use with web-fed rotary printing machines are generally well known in the art. These units are apt to be quite complex since they must often distribute printing inks of various thicknesses onto printing plates of various compositions. Thus, the inking units often have complex metering arrangements, complicated roller surface structures, multiple roller pair arrays and the like. While these units ae well suited for the bulk of the uses to which they are put, there is a need for a simplified inking unit which can be used with a simplified, web-fed rotary printing machine of the type described at pages 8 and 10 of the periodical "DEUTSCHER DRUCKER" No. 10, published Mar. 18, 1982.

SUMMARY OF THE INVENTION

It is an object of the present invention to provide a simplified inking unit.

Another object of the present invention is to provide a simplified inking unit for use in a web-fed rotary printing machine.

A further object of the present invention is to provide a simplified inking unit which does not require ink fountain adjustment screws.

Yet another object of the present invention is to provide a simplifier inking unit which will be free of any "ghosting" effect.

Still a further object of the present invention is to provide a simplified inking unit which uses thinly liquid printing ink and is suitable for inking hard printing plates.

As will be set forth in greater detail in the description of a preferred embodiment, as set forth hereinafter, the present invention is directed to a simplified inking unit for use in a web-fed rotary printing machine. The inking unit includes an ink fountain roller rotating in an ink fountain that carries a thinly liquid printing ink. This ink fountain roller is contacted by a finely screened ink metering roller which also contacts an inking roller whose surface may be rubber coated. The inking roller and plate cylinder with which it cooperates are preferably of the same diameter and rotate at the same peripheral speed. The ink metering roller and ink fountain roller have diameters that are preferably the same as each other but less than those of the inking roller and plate cylinder. Further, the metering roller and ink fountain roller both rotate at peripheral speeds different from each other and less than that of the inking roller with the ink fountain roller having the slowest peripheral speed.

The simplified inking unit in accordance with the present invention is well suited for use with the simplified web-fed rotary printing machines such as the one set forth in the previously mentioned periodical article. The present inking unit does not require the use of ink fountain adjustment screws and is free of the "ghosting" effect. The unit is particularly suited for use in inking hard printing plates such as ones consisting of metal or a hard synthetic material. This simplified inking unit is also suited for use with thinly liquid printing inks.

BRIEF DESCRIPTION OF THE DRAWING

While the novel features of the simplified inking unit in accordance with the present invention are set forth with particularlity in the appended claims, a full and complete understanding of the invention may be had by referring to the description of a preferred embodiment, as set forth hereinafter, and as may be seen in the accompanying drawing FIGURE which is a schematic side elevation view of a simplified inking unit in accordance with the present invention with portions removed for clarity.

DESCRIPTION OF THE PREFERRED EMBODIMENT

Referring now to the sole drawing FIGURE, there may be seen a preferred embodiment of a simplified inking unit in accordance with the present invention. The inking unit is positioned in a printing unit, generally at 1, which is intended for use in a web-fed rotary printing machine. Such a printing unit includes one or more counter-pressure cylinders 2 which are of a type generally well known in the letterpress printing art.

A plate cylinder 3 carries one or more letterpress printing plates 4, that can be made from a metal alloy or a synthetic material, and cooperates in a conventional manner with a corresponding one of the counter-pressure cylinders 2. A surface of a paper web 6 is printed as it passes between each such plate cylinder 3 and cooperating counter-pressure cylinder 2.

Each printing plate 4 is inked by an inking roller 7 which is preferably provided with a rubber or similar resilient coating. The inking roller 7 has a diameter equal to that of the plate cylinder 3 in the preferred embodiment, and is caused to rotate at the same peripheral speed as the plate cylinder 3. The inking roller 7 is mounted and driven in a suitable manner (not shown) so that is can be moved into and out of contact with the plate cylinder 3. Such mounting and driving means are generally well known in the art. A reciprocating ink distributing roller 8 contacts the surface of the inking roller 7 and distributes the ink on the surface of roller 7.

An ink fountain 9 is provided for each counter-pressure cylinder 2 and plate cylinder 3 pair and includes an ink bath of thinly liquid printing ink. A driven ink fountain roller 11, which carries a non-metallic cover that may be, for example, a rubber mixture, is rotated in the ink fountain so that the printing ink will be picked up by the surface of the ink fountain roller 11. A driven, finely screened ink metering roller 12 is carried adjacent the ink fountain roller and is pressed against the surface of the ink fountain roller 11. Both the ink fountain roller 11 and the ink metering roller 12 are supported in a common, displaceable frame which is not specifically shown in the drawing. It will be understood that any such frame could be employed for the purpose of supporting these rollers so that they can be moved together. The ink metering roller 12 also contacts the surface of the inking roller 7 when the assembly is in its operative mode. Due to the displaceable frame, the ink metering roller 12 and ink fountain roller 11 can be moved so that the metering roller 12 can be brought into or out of contact with the inking roller 7.

The ink metering roller 12 and the ink fountain roller 11 are preferably the same diameter which is smaller than the diameter of the inking roller 7. In the preferred embodiment, ink metering roller 12 and ink fountain roller 11 have diameters which are half the diameter of the inking roller 7. The ink fountain roller 11 rotates with a peripheral speed that is less than the peripheral speed of rotation of the ink metering roller 12. The peripheral speed of ink metering roller 12, while greater than that of ink fountain roller 11, is less than the peripheral speed of inking roller 7. Ink metering roller 12 is preferably driven by a speed adjustable drive such as, for example, a suitably controlled electric drive that is not shown. Ink metering roller 12 could also be provided with a suitable cooperating doctor blade, if desired. Thus, during normal printing operations, thinly liquid ink is picked up from the ink fountain 9 by the driven ink fountain roller 11, is spread by and transferred to the surface of the more rapidly rotating ink metering roller 12, and is again spread and transferred from metering roller 12 to the surface of the more rapidly rotating inking roller 7. Here it is further distributed by the reciprocating ink distribution roller 8 and is picked up by the hard surfaces of the printing plate or plates 4 carried on the periphery of plate cylinder 3. From there, the ink is used to print on the surface of the paper web 6 as it passes between the plate cylinder 3 and counter-pressure cylinder 2.

During "printing off", the inking roller 7 is moved off the plate cylinder 3 so that their surfaces are no longer in contact. However, their drive gears remain in contact so that their speeds remain the same. In situations where the printing machines stands still for a short period of time, the ink metering roller 12 and ink fountain roller 11 are moved, as a unit, out of contact with the inking roller 7. They, however, continue to rotate in contact with each other.

The simplified inking unit in accordance with the present invention provides a simple, durable inking assembly for use with a simplified web-fed rotary printing machine. It does not require complex ink metering means and still supplies ink to the ink roller in an efficient manner. While a preferred embodiment of the simplified inking unit in accordance with the present invention has been set forth with particularity, it will be obvious to one of skill in the art that a number of changes could be made without departing from the true spirit and scope of the invention and that accordingly, the invention is to be limited only by the appended claims.

I claim:

1. A simplified inking unit for use in a printing unit of a web-fed rotary printing machine to distribute a thinly liquid printing ink onto a letterpress printing plate carried on a rotatable plate cylinder which cooperates with a counter-pressure cylinder to print a web of paper, said simplified inking unit consisting of four rollers including:

a rotatable inking roller having a diameter and peripheral speed of rotation the same as the plate clyinder;

a finely screened, rotatable ink metering roller having a diameter and peripheral speed of rotation less than those of said inking roller, said ink metering roller being carried on a movable frame and being movable into and out of contact with said inking roller;

a rotatable ink fountain roller in contact with the thinly liquid printing ink in an ink fountain, said ink fountain roller having a diameter less than the diameter of said inking roller and a peripheral speed of rotation less than that of said ink metering roller, said ink fountain roller being carried on said movable frame with said ink metering roller and being in contact with said ink metering roller; and an ink distributing roller in contact with a surface portion of said inking roller.

* * * * *